United States Patent [19]

Kobayashi et al.

[11] Patent Number: 4,732,132

[45] Date of Patent: Mar. 22, 1988

[54] AIR INTAKE SIDE SECONDARY AIR SUPPLY SYSTEM FOR AN INTERNAL COMBUSTION ENGINE USING A LINEAR-TYPE SOLENOID VALVE

[75] Inventors: Hideo Kobayashi, Kawagoe; Kazuhito Kakimoto, Asaka; Yutaka Otobe, Shiki; Hitoshi Yamabe, Saitama; Hiroshi Hasebe, Hatogaya; Norio Tomobe, Asaka, all of Japan

[73] Assignee: Honda Giken Kogyo Kabushiki Kaisha, Tokyo, Japan

[21] Appl. No.: 875,794

[22] Filed: Jun. 18, 1986

[30] Foreign Application Priority Data

Jun. 28, 1985 [JP] Japan ..... 60-142706

[51] Int. Cl.[4] ..... F02M 23/06; F02M 23/08

[52] U.S. Cl. ..... 123/587; 123/589

[58] Field of Search ..... 123/589, 339

[56] References Cited

U.S. PATENT DOCUMENTS 4,364,227 12/1982 Yoshida et al. ..... 123/589
4,478,191 10/1984 Kinoshita et al. ..... 123/589

FOREIGN PATENT DOCUMENTS 119941 9/1980 Japan ..... 123/589
0119941 9/1980 Japan .
0195042 11/1983 Japan .
0124053 7/1983 Japan .

*Primary Examiner*—William A. Cuchlinski, Jr.
*Attorney, Agent, or Firm*—Pollock, Vande Sande and Priddy

[57] ABSTRACT

An air intake side secondary air supply system for an internal combustion engine is provided with a linear type solenoid valve disposed in an air intake side secondary air supply passage leading to an intake air passage, downstream from the throttle valve. The opening degree of the linear type solenoid valve is controlled continuously by a drive current supplied to the solenoid. The magnitude of the drive current of the solenoid is determined by providing a base value of current which is responsive to a plurality of engine parameters that represent the engine load, and by correcting the base value in accordance with a result of the sensing of concentration of an exhaust gas component.

5 Claims, 5 Drawing Figures

AIR INTAKE SIDE SECONDARY AIR SUPPLY SYSTEM FOR AN INTERNAL COMBUSTION ENGINE USING A LINEAR-TYPE SOLENOID VALVE

BACKGROUND OF THE INVENTION

1. Field of the Invention

The present invention relates to an air intake side secondary air supply system for an internal combustion engine, and more particularly to a system in which a linear-type solenoid valve is utilized for controlling the supply of the secondary air.

2. Description of Background Information

Air intake side secondary air supply systems are known as systems in which oxygen concentration in the exhaust gas of the engine is detected and an air-fuel ratio of the mixture to be supplied to the engine is feedback controlled in response to a result of the detection of the oxygen concentration for the purification of the exhaust gas and the improvement of the fuel economy. As an example of the air intake side secondary air supply system, Japanese Patent Publication No. 55-119941 discloses a system which uses a linear-type solenoid valve whose opening degree is varied with the magnitude of a current supplied to its solenoid. The linear-type solenoid valve is disposed in an air supply passage leading to a carburetor of the engine downstream of the throttle valve and a sectional area of the air supply passage is continuously varied by the linear-type solenoid valve in response to a result of the detection of the oxygen concentration.

However, in this air intake side secondary air supply system, there was a drawback that the magnitude of the current supplied to the solenoid of the linear-type solenoid valve is not responsive to the load of the engine. Therefore, it was sometimes experienced that the system fails to adjust the air/fuel ratio rapidly toward an appropriate value in response to changes in the driving state. In short, the system was not responsive enough to the change in the driving state.

OBJECT AND SUMMARY OF THE INVENTION

An object of the present invention is to provide an air intake side secondary air supply system using a linear type solenoid valve in which the operation of the system in response to changes in the driving state is very much improved.

According to the present invention, an air intake side secondary air supply system includes a control unit which sets a base current value for a linear-type solenoid valve in response to a plurality of parameters of the engine operation relating to the engine load, and determines a current value to be supplied to the linear-type solenoid valve by correcting the base current value in response to the concentration of an exhaust gas component, and a current supply device which supplies a drive current having a magnitude equal to the current value determined by the control unit to the linear-type solenoid valve.

DETAILED DESCRIPTION OF THE PREFERRED EMBODIMENTS

Figure 1:
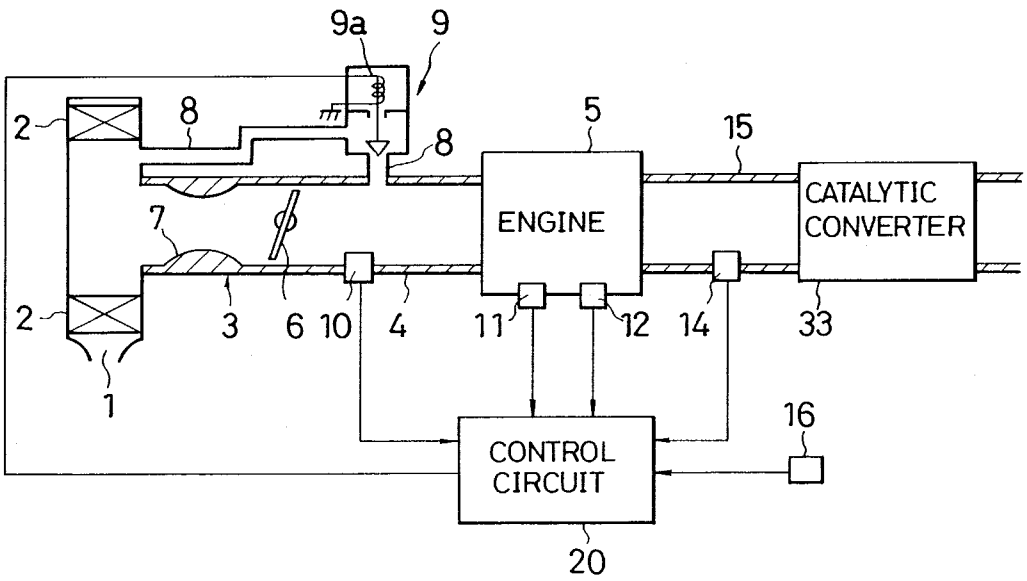
FIG. 1 is a schematic diagram showing a general construction of the system according to the invention.

Referring first to FIG. 1 of the accompanying drawings, the preferred embodiment of the air intake side secondary air supply system according to the present invention will be explained hereinafter.

FIG. 1 illustrates a general construction of the air intake side secondary air supply system for an internal combustion engine for vehicles. Intake air taken at an air inlet port 1 is supplied to an internal combustion engine 5 through an air cleaner 2, a carburetor 3, and an intake manifold 4. The carburetor 3 is provided with a throttle valve 6 and a venturi 7 on the upstream side of the throttle valve 6. An inside of the air cleaner 2, near an air outlet port, communicates with the intake manifold 4 via an air intake side secondary air supply passage 8. The air intake side secondary air supply passage 8 is provided with a linear type solenoid valve 9. An opening degree of the linear type solenoid valve 9 varies with the magnitude of a drive current supplied to its solenoid 9*a*.

The system also includes an absolute pressure sensor 10 which is provided in the intake manifold 4 for producing an output signal whose level corresponds to an absolute pressure within the intake manifold 4, a crank angle sensor 11 which produces pulse signals in response to the revolution of an engine crankshaft (not shown) of the engine 5, an engine cooling water temperature sensor 12 which produces an output signal whose level corresponds to the temperature of engine cooling water, and an oxygen concentration ($O_2$) sensor 14 which is provided in an exhaust manifold 15 of the engine 5 for generating an output signal whose level is responsive to an oxygen concentration in the exhaust gas.

A catalytic converter 33 is provided in the exhaust manifold 15, downstream from the $O_2$ sensor 14, for accelerating the reduction of the noxious components in the exhaust gas. The linear type solenoid valve 9, the absolute pressure sensor 10, the crank angle sensor 11, the engine cooling water temperature sensor 12, and the $O_2$ sensor 14 are electrically connected to a control circuit 20. Further, a vehicle speed sensor 16 which produces an output signal whose level is responsive to the speed of the vehicle is electrically connected to the control circuit 20.

Figure 2:
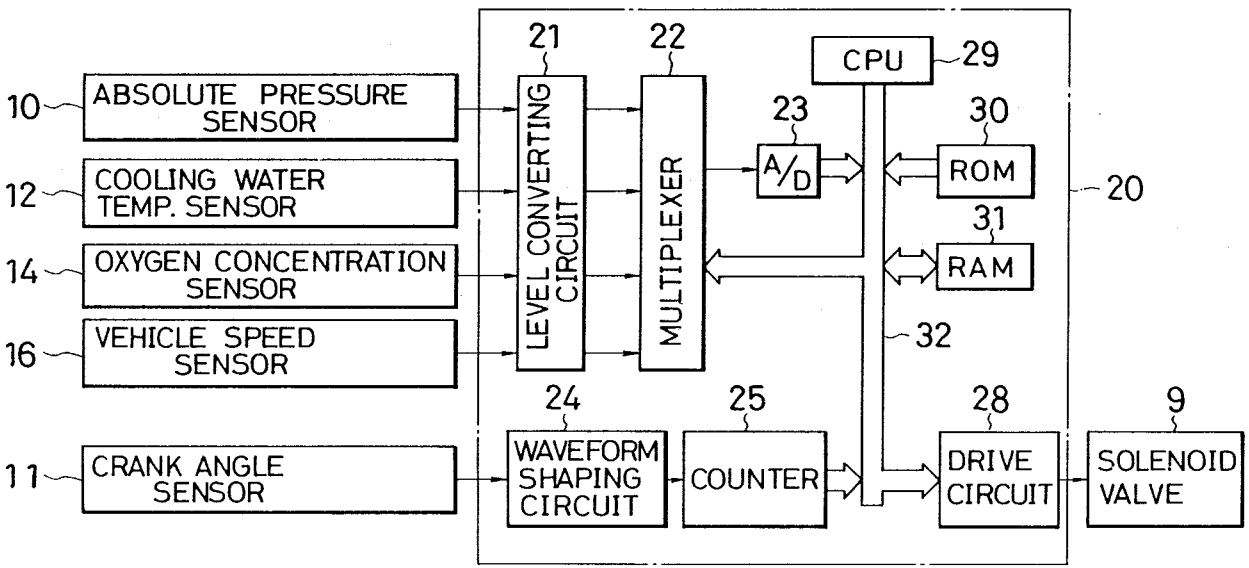
FIG. 2 is a block diagram showing the construction of the control circuit 20 of the system of FIG. 1.

FIG. 2 shows the construction of the control circuit 20. As shown, the control circuit 20 includes a level converting circuit 21 which performs a level conversion of the output signals of the absolute pressure sensor 10, the engine cooling water temperature sensor 12, the $O_2$ sensor 14, and the vehicle speed sensor 16. Output signals provided from the level converting circuit 21 are in turn supplied to a multiplexer 22 which selectively outputs one of the output signals from each sensor passed through the level converting circuit 21. The output signal provided by the multiplexer 22 is then supplied to an A/D converter 23 in which the input signal is converted into a digital signal. The control circuit 20 further includes a waveform shaping circuit 24 which conducts a waveform shaping of the output signal of the crank angle sensor 11, to provide TDC signals in the form of a pulse train. The TDC signals from the waveform shaping circuit 24 are in turn supplied to a counter 25 which counts intervals of the TDC signals. The control circuit 20 includes a drive circuit 28 for driving the linear type solenoid valve 9, a CPU (central processing unit) 29 which executes digital calculation operations in accordance with various programs, a ROM 30 in which various operating programs and data are previously stored, and a RAM 31. The solenoid 9a of the linear type solenoid valve 9 is connected in series with a drive transistor and a current detection resistor (both are not illustrated) of the drive circuit 28, and a power voltage is applied across two ends of the series circuit. The multiplexer 22, the A/D converter 23, the counter 25, the drive circuit 28, the CPU 29, the ROM 30, and the RAM 31 are mutually connected via an input/output bus 32.

In the thus constructed control circuit 20, information of the absolute pressure in the intake manifold 4, the engine cooling water temperature, the oxygen concentration in the exhaust gas, and the vehicle speed, is selectively supplied from the A/D converter 23 to the CPU 29 via the input/output bus 32. Also, information indicative of the engine speed from the counter 25 is supplied to the CPU 29 via the input/output bus 32. The CPU 29 is constructed to generate an internal interruption signal every predetermined time period $T_1$ (50 m sec, for instance), as explained later. In response to this internal interruption signal, the CPU 29 calculates data of the magnitude of the supply current $D_{OUT}$ to the solenoid 9a of the linear type solenoid valve 9 and supplies the calculated data of supply current value $D_{OUT}$ to the drive circuit 28. The drive circuit 28 executes a closed loop control of the magnitude of the drive current flowing through the solenoid 9a so that the current value becomes equal to the calculated supply current value $D_{OUT}$.

Figure 3:
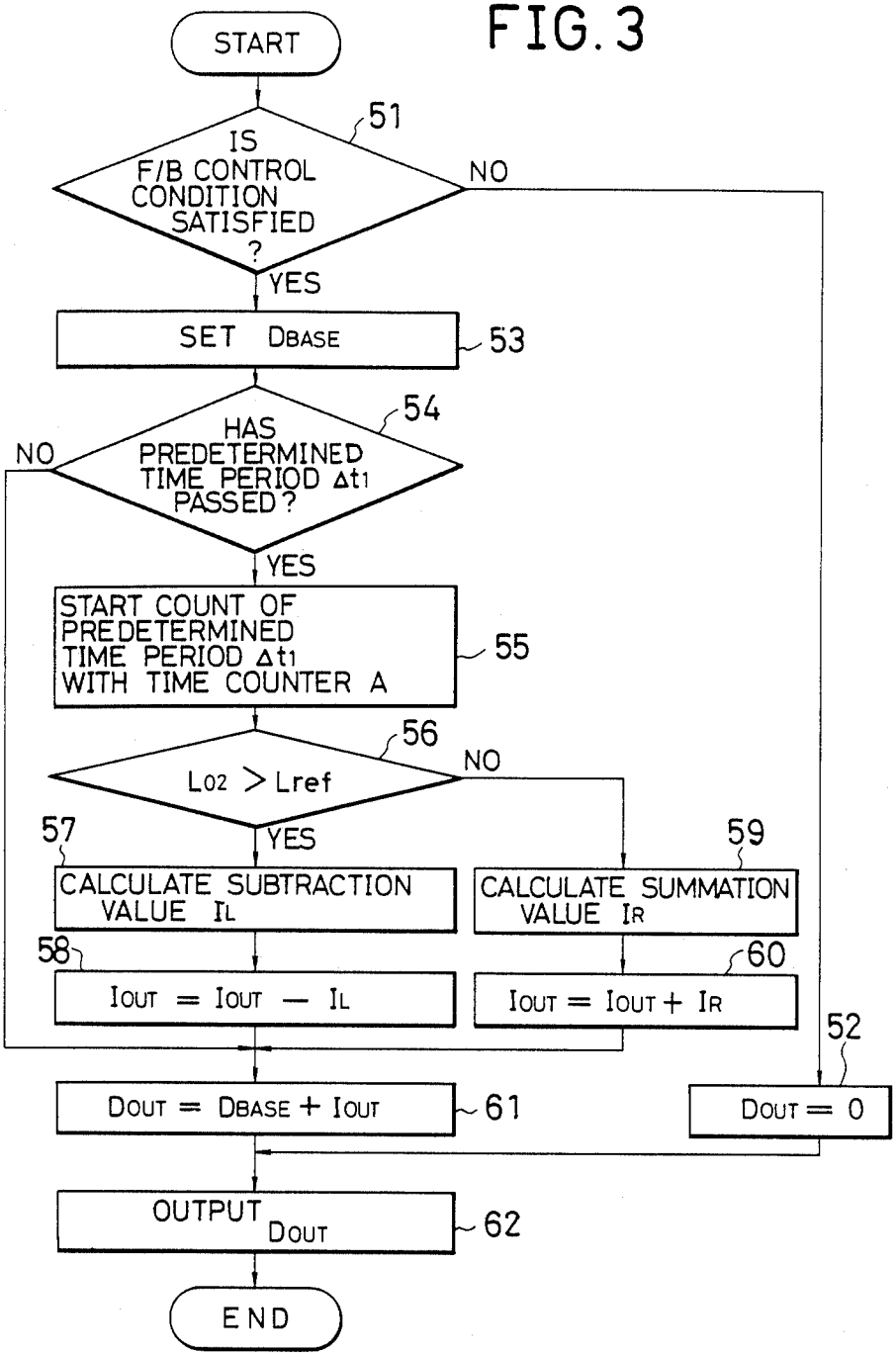
FIG. 3 is a flowchart showing the manner of operation of the control circuit 20 in a preferred embodiment of the air/fuel ratio control system according to the present invention.

Referring to the flowchart of FIG. 3, the operation of the air/fuel ratio control system according to the present invention will be explained hereinafter.

Figure 4:
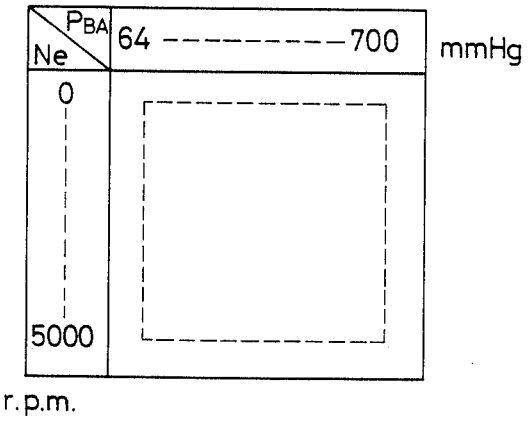
FIG. 4 is a diagram showing a data map which is previously stored in a ROM 30 of the control circuit 20.
Figure 5:
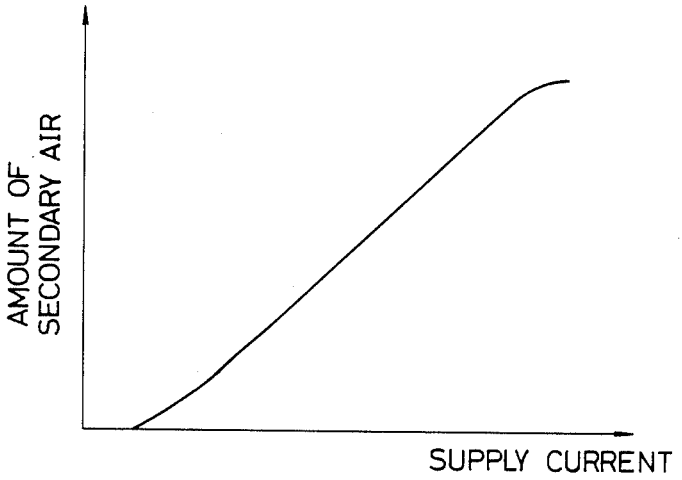
FIG. 5 is a diagram showing a relation between the magnitude of the drive current to the solenoid valve and the amount of the secondary air.

The CPU 29 first detects, at a step 51, whether or not the operating state of the vehicle (including operating states of the engine) satisfies a condition for the feedback (F/B) control at each time of the generation of the internal interruption signal. This detection is performed according to various parameters, i.e., the absolute pressure within the intake manifold, the engine cooling water temperature, the vehicle speed, and the engine rotational speed. For example, when the vehicle speed is low, or when the engine cooling water temperature is low, it is determined that the condition for the feedback control is not satisfied. If it is determined that the condition for the feedback control is not satisfied, the supply current value $D_{OUT}$ is made equal to "0" at a step 52 to stop the air/fuel ratio feedback control. On the other hand, if it is determined that the condition for the feedback control is satisfied, a base current value $D_{BASE}$ of the current to be supplied to the linear type solenoid valve 9 is set at a step 53. In the ROM 30, various values of the base current value $D_{BASE}$ which are determined according to the absolute pressure within the intake manifold $P_{BA}$ and the engine speed $N_e$ are previously stored in the form of a $D_{BASE}$ data map as shown in FIG. 4. The CPU 29 reads present values of the absolute pressure $P_{BA}$ and the engine speed $N_e$ and in turn searches a value of the base current value $D_{BASE}$ corresponding to the read values from the $D_{BASE}$ data map in the ROM 30. Then, whether or not a count period of a time counter A incorporated in the CPU 29 (not shown) has reached a predetermined time period $\Delta t_1$ is detected at a step 54. This predetermined time period $\Delta t_1$ corresponds to a delay time between a time of the supply of the air intake side secondary air and a time in which a result of the supply of the air intake side secondary air is detected by the $O_2$ sensor 14 as a change in the oxygen concentration of the exhaust gas. When the predetermined time period $\Delta t_1$ has passed after the time counter A is reset to start the counting of time, the counter is reset again, at a step 55, to start the count of time from a predetermined initial value. In other words, a detection as to whether or not the predetermined time period $\Delta t_1$ has passed after the start of the counting of time from the intital value by the time counter A, i.e. the execution of the step 55, is performed at the step 54. After the start of the counting of the predetermined time period $\Delta t_1$ by the time counter A in this way, whether or not an output signal level $LO_2$ of the $O_2$ sensor 14 is greater than a reference level $L_{ref}$ corresponding to a target air/fuel ratio is detected at a step 56. In other words, whether or not the air/fuel ratio of the mixture to be supplied to the engine 5 is leaner than the target air/fuel ratio is detected at this step. If $LO_2 > Lref$, this means that the air/fuel ratio of the mixture is leaner than the target air/fuel ratio, and a subtraction value $I_L$ is calculated at a step 57. The subtraction value $I_L$ is obtained by a multiplication among a constant $K_1$, the engine speed $N_e$, and the absolute pressure $P_{BA}$, ($K_1 \cdot N_e \cdot P_{BA}$), and is dependent on the amount of the intake air of the engine 5. After the calculation of the subtraction value $I_L$, a correction value $I_{OUT}$ which is previously calculated by the execution of this routine is read out from a memory location $a_1$ in the RAM 31. Subsequently, the subtraction value $I_L$ is subtracted from the correction value $I_{OUT}$, and a result is in turn written in the memory location $a_1$ of the RAM 31 as a new correction value $I_{OUT}$, at a step 58. On the other hand, if $LO_2 \leqq Lref$ at the step 56, it means that the air/fuel ratio is richer than the target air/fuel ratio, and a summing value $I_R$ is calculated at a step 59. The summing value $I_R$ is calculated by a multiplication among a constant value $K_2$ ($\neq K_1$), the engine speed $N_e$, and the absolute pressure $P_{BA}$ ($K_2 \cdot N_e \cdot P_{BA}$), and is dependent on the amount of the intake air of the engine 5. After the calculation of the summing value $I_R$, the correction value $I_{OUT}$ which is previously calculated by the execution of this routine is read out from the memory location $a_1$ of the RAM 31, and the summing value $I_R$ is added to the read out correction value $I_{OUT}$. A result of the summation is in turn stored in the memory location $a_1$ of the RAM 31 as a new correction value $I_{OUT}$ at a step 60. After the calculation of the correction value $I_{OUT}$ at the step 58 or the step 60 in this way, the correction value $I_{OUT}$ and the base current value $D_{BASE}$ set at the step 53 are added together, at a step 61 so that a result of addition is used as the supply current value $D_{OUT}$. The supply current value $D_{OUT}$ is then output to the drive circuit 28 at a step 62.

The drive circuit 28 is constructed to detect the magnitude of the current flowing through the solenoid 9a of the solenoid valve 9 by means of the current detection resistor. The drive circuit 28 further compares the detected current value with the supply current value $D_{OUT}$, and supplies the current to the solenoid by controlling an on/off operation of the drive transistor in accordance with the result of the comparison. Thus, the solenoid 9a of the solenoid valve 9 is supplied with a current whose magnitude is equal to the supply current value $D_{OUT}$ and the air intake side secondary air whose amount is proportional to the magnitude of the current flowing through the solenoid 9a of the solenoid valve 9 is supplied to the intake manifold 4.

After the reset of the time counter A and the start of the counting from the initial value at the step 55, if it is detected that the predetermined time period $\Delta t_1$ has not yet passed at the step 54, the operation of the step 61 is immediately executed. In this case, the correction value $I_{OUT}$ obtained by the execution of this routine up to the previous cycle is read out.

Thus, the air intake side secondary air supply system according to the present invention, is provided with the linear type solenoid valve 9 whose opening degree is varied in response to the magnitude of the supply current value DOUT. With this linear type solenoid valve 9, the sectional area of the air intake side secondary air supply passage 8 is varied continuously. It is to be noted, the control range of the air intake side secondary air amount is widened by this linear type solenoid valve as compared with the usual on/off type solenoid valve. Further, the efficiency of the exhaust gas purification is improved because the supply current value $D_{OUT}$ is determined by correcting the base current value $D_{BASE}$ in response to the output signal level of the $O_2$ sensor 14.

It will be appreciated from the foregoing that in the air intake side secondary air supply system according to the present invention, the linear type solenoid valve whose opening degree is controlled by the level of the supply current is provided in the air intake side secondary air supply passage, and a plurality of parameters of engine operation relating to the engine load are utilized to set a base current value to be supplied to the solenoid valve. The base current value is further corrected in response to the exhaust gas component concentration, to determine the magnitude of the current to be supplied to the solenoid valve. Therefore, the magnitude of the current supplied to the solenoid valve is varied in response to changes in the operating condition of the engine, so that the response characteristic of the air/fuel ratio of mixture is very much improved.

What is claimed is:

1. An air intake side secondary air supply system for an internal combustion engine having an intake air passage with a carburetor and a throttle valve and an exhaust gas passage, comprising:

an air intake side secondary air supply passage leading to said intake air passage downstream from the throttle valve;

a solenoid valve disposed in said air intake side secondary air supply passage, the opening degree of said solenoid valve being varied continuously in response to the magnitude of a drive current supplied to a solenoid thereof so that a flow area of said air intake side secondary air supply passage is varied continuously;

first sensor means disposed in said exhaust gas passage for sensing the concentration of an exhaust gas component of the engine and producing a sensor output signal indicative of said concentration;

further sensor means for monitoring a plurality of parameters indicative of the operating state of said engine and operative to produce output signals indicative of the magnitude of said parameters; and control means connected to each of said sensor means for effecting feedback control of the air-fuel ratio of the mixture to be supplied to said engine, said control means including means responsive to selected ones of said plurality of parameters representing the load on said engine for setting a base value, other than zero, of said drive current to be used in effecting such feedback control, and means responsive to said sensor output signal from said first sensor means for modifying the set base value of said drive current to determine a supply current value to be used in effecting such feedback control;

said control means also including current supply means connected to said solenoid of said solenoid valve for supplying said solenoid with drive current having the supply current value determined by said control means.

2. An air intake side secondary air supply system as set forth in claim 1, in which said plurality of parameters representing engine load include the engine rotational speed and the pressure in said intake air passage.

3. The air intake side secondary air supply system of claim 1 wherein said control means includes data storage means for storing a plurality of drive current base values for a plurality of related engine loads, said means for setting a base value of drive current comprising means for reading a current base value from a location in said data storage means determined by said selected ones of said plurality of parameters.

4. The air intake side secondary air supply system of claim 3 wherein said selected ones of said plurality of parameters include the engine rotational speed.

5. The air intake side secondary air supply system of claim 3 wherein said selected ones of said plurality of parameters include the pressure in said intake air passage.

* * * * *